US007331759B1

(12) United States Patent
Tejeda

(10) Patent No.: US 7,331,759 B1
(45) Date of Patent: Feb. 19, 2008

(54) DRYING FAN

(75) Inventor: Marco A. Tejeda, Madison, WI (US)

(73) Assignee: Bou-Matic Technologies Corporation, Madison, WI (US)

( * ) Notice: Subject to any disclaimer, the term of this patent is extended or adjusted under 35 U.S.C. 154(b) by 262 days.

(21) Appl. No.: 11/068,366

(22) Filed: Feb. 28, 2005

Related U.S. Application Data

(60) Provisional application No. 60/550,012, filed on Mar. 4, 2004.

(51) Int. Cl.
*F04D 29/54* (2006.01)

(52) U.S. Cl. ..... 415/221; 416/189; 416/244 R; 415/211.2

(58) Field of Classification Search ..... 415/220, 415/221, 222, 211.2; 416/189, 244 R, 63
See application file for complete search history.

(56) References Cited

U.S. PATENT DOCUMENTS 2,830,779 A * 4/1958 Wentling ..... 248/662
3,286,368 A 11/1966 Thomas
4,145,821 A * 3/1979 Schantz ..... 34/237
5,636,103 A * 6/1997 Bushner ..... 361/395
5,772,500 A 6/1998 Harvey et al.
5,803,709 A * 9/1998 Matthews et al. ..... 415/182.1
5,893,216 A 4/1999 Smith et al.
6,111,748 A 8/2000 Bhatia
6,254,343 B1 * 7/2001 Schmidt et al. ..... 415/222
6,647,639 B1 11/2003 Storrer

FOREIGN PATENT DOCUMENTS

JP 358038319 3/1983
JP 406042498 2/1994

OTHER PUBLICATIONS

Injectidry Product Line, Injectidry Systems, Inc., website: http://www.injectidry.com/PRODUCTS.PDF (visited Feb. 17, 2004).
Dri-Eaz Ace Turbo Dryer—stackable airmover, website: http://www.dri-eaz.com/products/ace.html (visited Jan. 21, 2005).
Dry Air Force Air Movers at Jon-Don, website: http://jondon.com/galeforce/default.htm (visited Jan. 21, 2005).

* cited by examiner

*Primary Examiner*—Ninh H. Nguyen
(74) *Attorney, Agent, or Firm*—Andrus, Sceales, Starke & Sawall, LLP

(57) ABSTRACT

A drying fan, including for water damage restoration, including for drying a room corner extending axially along an interface between a wall and a floor, has a shrouded housing having an axial flow path therethrough, an intake cowling receiving intake air, and an exhaust cowling discharging exhaust air and having a tapered ramp both a) expanding the airflow and b) directing the airflow where desired.

28 Claims, 13 Drawing Sheets

DRYING FAN

CROSS-REFERENCE TO RELATED APPLICATIONS

This application claims the benefit of and priority from Provisional U.S. Patent Application No. 60/550,012, filed Mar. 4, 2004. Reference is also made to commonly owned co-pending U.S. patent application Ser. No. 11/068,341, filed on even date herewith, incorporated herein by reference.

BACKGROUND AND SUMMARY

The invention relates to drying fans, including for water damage restoration and other applications.

In the water damage restoration industry, fans are used for drying a water damaged structure, including carpeting, furniture, framework, etc. If water can be evaporated quickly, damage can be minimized. The fans move air over the water damaged surfaces at high velocity. The two types of fans typically used are axial propeller type fans and centrifugal squirrel cage type fans. The present invention is directed to improvements in axial fans because of their lower electrical current requirements.

The corner between a wall and a floor is the most difficult area to dry and takes the longest time to dry. The present invention addresses and solves this problem with an axial flow fan. The invention has particularly desirable application to water damage restoration, though may be used in other applications therebeyond.

The present invention focuses the drying air toward the problem area of the room. In the preferred embodiment, this is accomplished by a desirably shaped exhaust duct downstream of the axial fan blades, which exhaust duct both: a) provides expansion of the airflow where desired; and b) directs the airflow where desired. In one particularly desirable embodiment, the exhaust duct geometry directs expansion of air into a problem area such as a corner by allowing the air to expand predominantly only in one direction chosen to be the direction of the most difficult to dry location in the room.

In one aspect, a downwardly sloping ramp is provided in the exhaust duct. The ramp is located at a downstream location spaced from the axial fan blades as far as possible, and the ramp pitch is minimized, due to the inability of the axial fan blades to produce static pressure. Without static pressure, if one attempts to expand the air too quickly, the result is a dramatic loss of velocity. The length of the duct downstream of the blades must be optimized. Too long of a length is a waste of material, whereas too short of a length will not provide desirably directed airflow.

In the preferred embodiment, the length of the duct upstream of the axial fan blades is minimized, to allow the blades to be supplied or "fed" with as much air as they can possibly move, and to avoid starving the blades for supply air. An intake cowling is provided and enhances this supply air.

In further embodiments, the axial fan blades are moved as close as possible to the wall and/or floor. This is desirable so that intake air does not have to change direction and accelerate before becoming exhaust air, or only has to undergo minimal directional change. The air moving through the fan stays close to the wall and/or floor in order to dry the wall and/or floor, particularly at the corner. Keeping the blades close to the wall and to the floor also eliminates the need for large radiused round cowling sections at the wall and/or the floor because the wall and floor upstream of the intake acts as a section of intake "duct". This "duct" helps the air to establish an axial direction of flow, and hence aids in supplying the blades with intake air. This intake air also aids in structure drying. In further embodiments, the remaining cowling sides opposite the wall and the floor may have maximized radii in order to aid air supply, with the limiting factor being exterior housing dimensions. In preferred embodiments, all exterior housing surfaces are shaped for portability and storable stackability.

Further desirable aspects include stator vanes removing downstream rotation from the air and transferring same into useful axial air velocity. In another aspect, stand mounting pads are provided with threaded inserts, allowing the operator to mount the fan quickly on a stand and pointed in a desired direction. In another aspect, motor mounting pads are provided, allowing for rigid assembly of the motor to the fan housing. In another aspect, desirable electrical component location is provided, allowing the operator to quickly and easily access and use the controls without bending over, and to quickly and easily access and use the controls in each of a first fan orientation providing a counterclockwise drying flow pattern around a room, and a second fan orientation providing a clockwise drying flow pattern around a room. In another aspect, a handle is offset to one side so that the operator does not have to carry the fan farther away from his/her body. The handle is also parallel to a flat side of the fan such that the operator does not have to twist his/her arm when carrying it nor have obstruction to the natural motion of his/her legs when walking. The handle is located close to the center of gravity, and when held, the fan hangs close to vertical and does not interfere with walking. In a further aspect, interlocking nubs are provided, allowing multiple fans to be stacked on one another. In another aspect, a cord wrap is provided, storing the cord within the circumscribing cuboid, keeping the cord out of the way during storage and transfer. In another aspect, variable height legs are provided, establishing a selectable pointed airflow angle, and allowing for air circulation below the fan.

DETAILED DESCRIPTION

Figure 1:
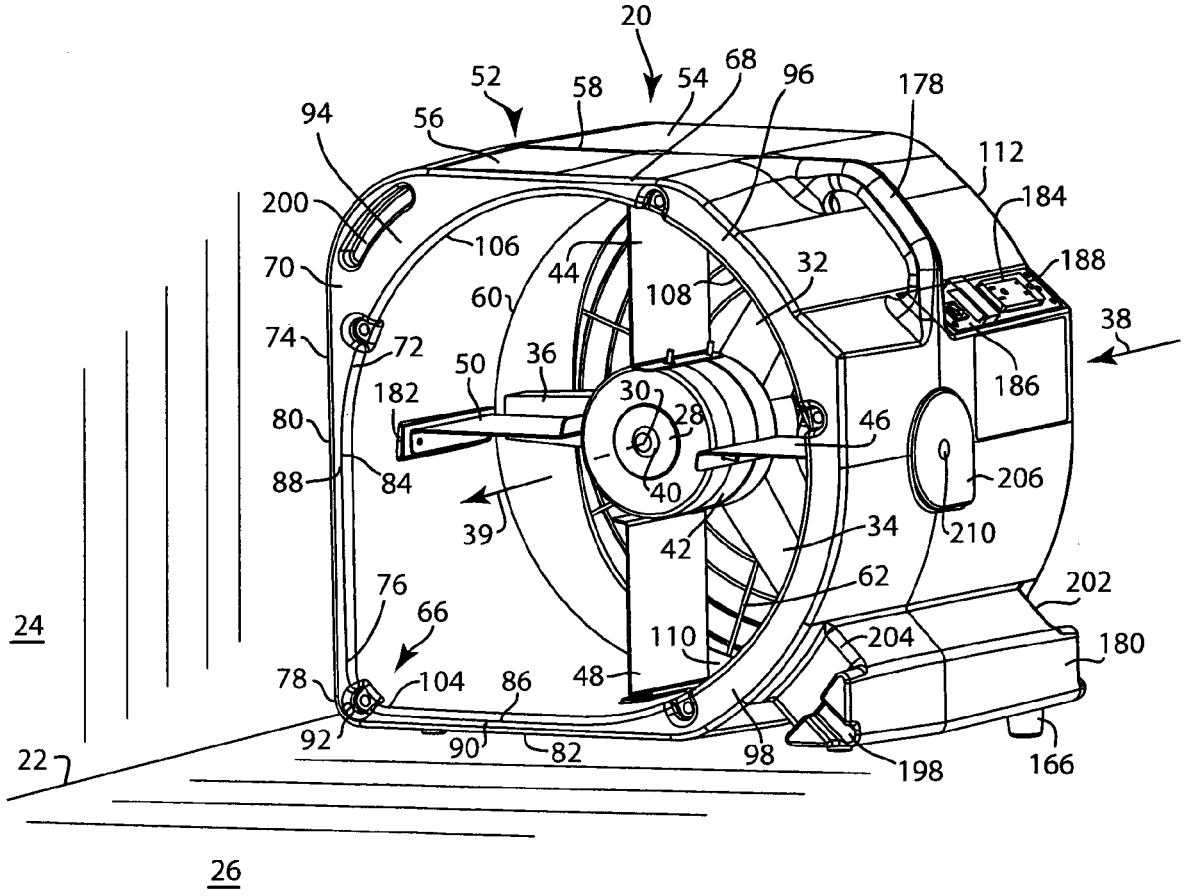
FIG. 1 is a perspective view of the outlet side of a drying fan in accordance with the invention.

FIGS. 1-4 show a drying fan 20 for water damage restoration, particularly for drying a room corner 22 extending axially along an interface between a wall 24 and a floor 26. A fan hub 28 is rotational about rotation axis 30 generally parallel to the noted axial extension of room corner 22, namely preferably within a cone at a compound angle less than or equal to about 10° tapered downwardly toward floor 26 and less than or equal to about 10° tapered inwardly toward wall 24. Hub 28 has a plurality of fan blades 32, 34, 36 extending radially therefrom for moving air along an axial flow direction from upstream to downstream as shown at arrows 38, 39, upon rotation of hub 28. Hub 28 is mounted on a motor shaft 40 of electrical motor 42 mounted by stator vanes 44, 46, 48, 50 in a shrouded housing 52 having an axial flow path therethrough as shown at arrows 38, 39 along axis 30.

Figure 5:
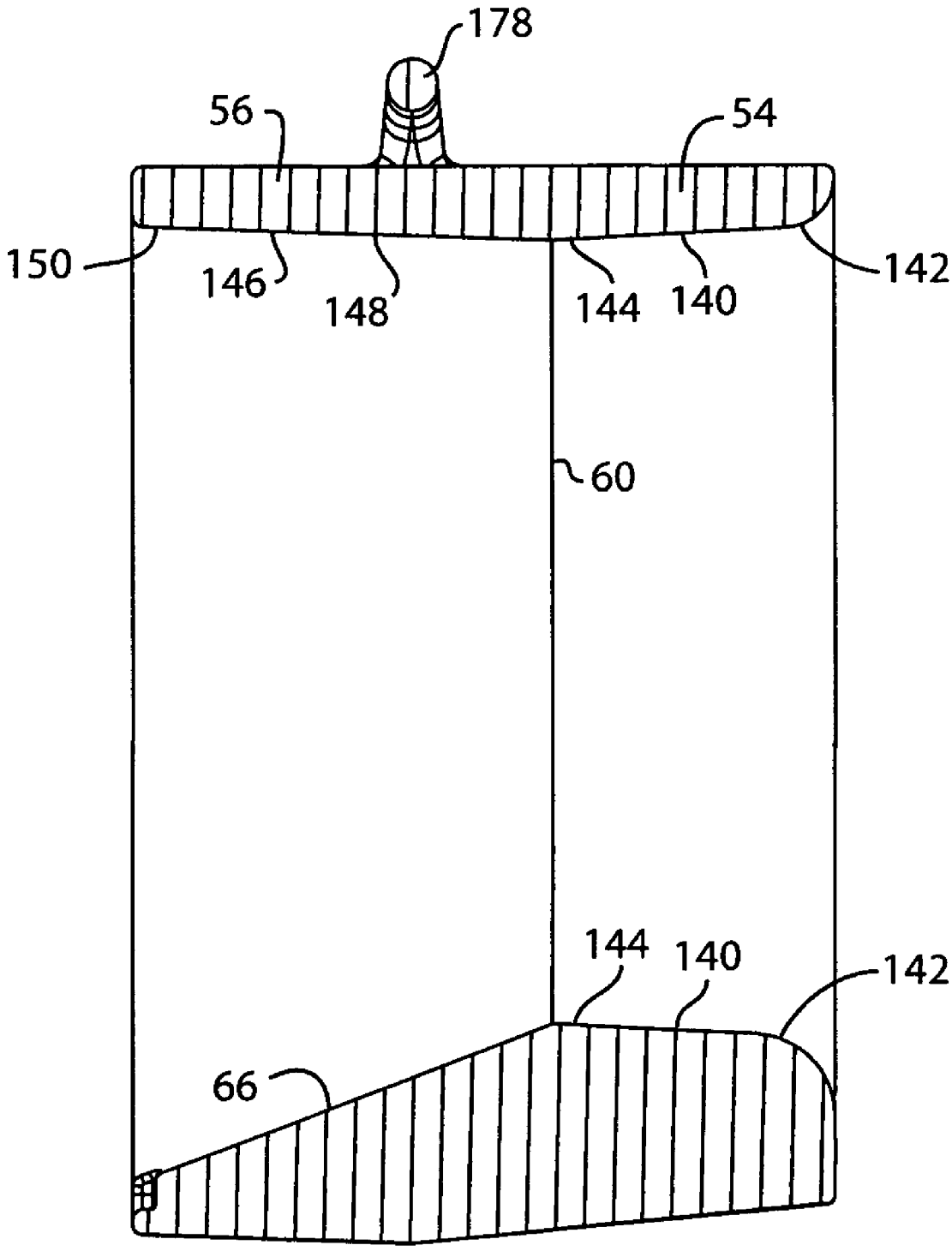
FIG. 5 is a sectional view taken along line 5-5 of FIG. 3.
Figure 6:
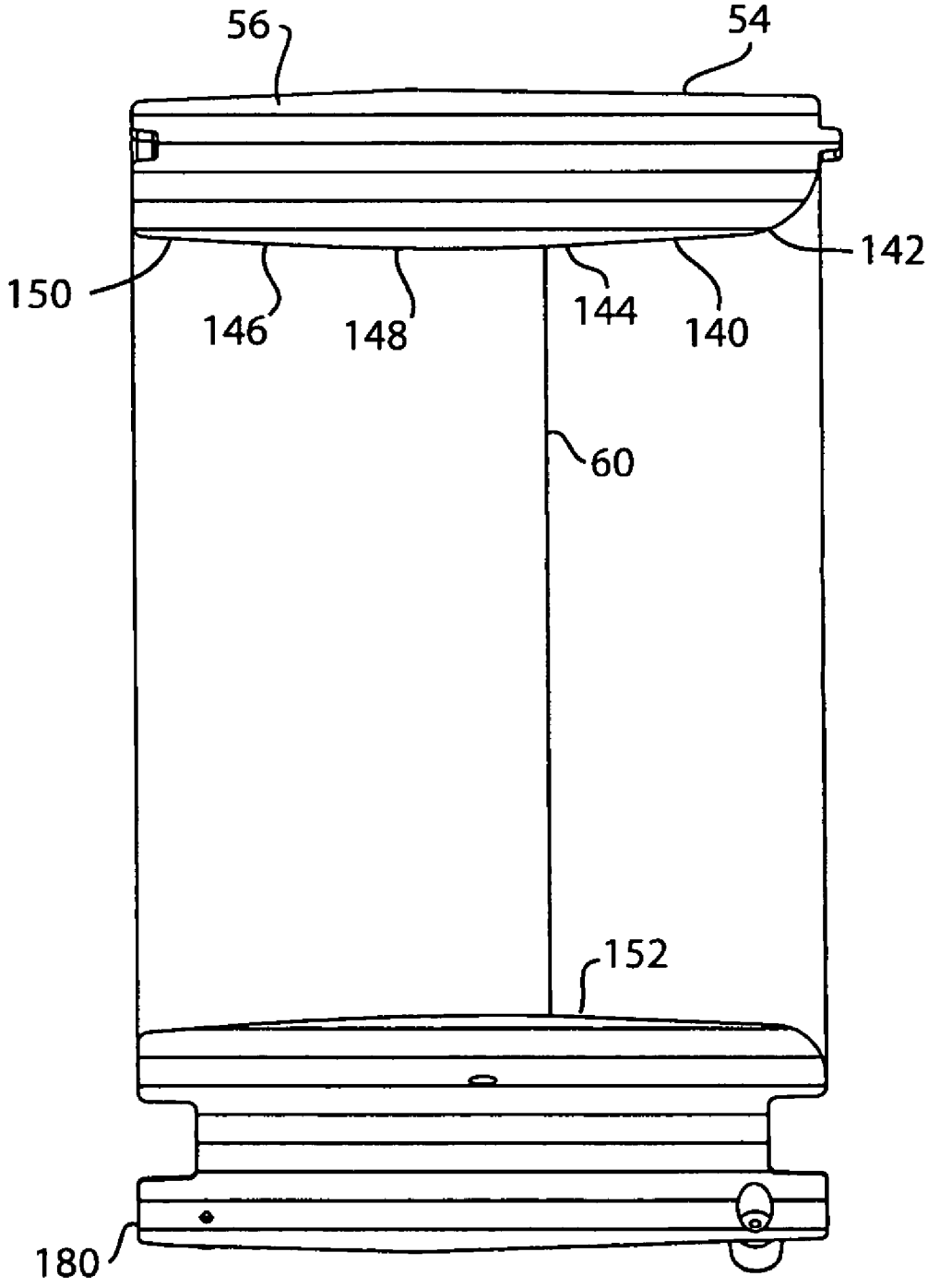
FIG. 6 is a sectional view taken along line 6-6 of FIG. 3.

Housing 52 is a plastic molded member, preferably polyethylene, preferably formed by rotational molding or blow molding, having an upstream inlet section 54 and a downstream outlet section 56, with an outer perimeter parting line 58 and an inner perimeter parting line 60 therebetween. Upstream section 54 provides an intake cowling receiving intake air as shown at arrow 38, and section 56 provides an exhaust cowling discharging exhaust air as shown at arrow 39. The inlet side of the housing is protectively covered by a grate 62, and the outlet side of the housing is protectively covered by a grate 64. Exhaust cowling 56 has a tapered ramp 66, FIGS. 1, 5, leading diagonally downwardly to room corner 22.

Exhaust cowling 56 has a downstream end 68 having an outlet face 70 lying in a plane preferably perpendicular or transverse to the rotational axis 30 of the fan hub. In other embodiments, axis 30 may be positioned at the noted compound cone angle within the noted cone, though the disclosed embodiment is preferred for easier manufacture, with face 70 perpendicular to axis 30, and the angle of axis 30 and axial flow direction 38, 39 being varied relative to wall 24 and/or floor 26 by variable height legs 162, 164, 166, 168, to be described. Outlet face 70 has a noncircular shape of variable radius from axis 30. Outlet face 70 is defined by an inner perimeter 72 and an outer perimeter 74 at downstream end 68 of exhaust cowling 56. At least one and preferably both of the noted perimeters have a noncircular shape of variable radius. Each of perimeters 72, 74 has a perimeter corner at room corner 22, namely an inner perimeter corner 76 at room corner 22, and an outer perimeter corner 78 at room corner 22. Outer perimeter 74 has straight sides 80 and 82 meeting at outer perimeter corner 78. Side 80 extends along wall 24. Side 82 extends along floor 26. Inner perimeter 72 has straight sides 84 and 86 meeting at inner perimeter corner 76. Side 84 extends generally parallel to wall 24. Side 86 extends generally parallel to floor 26. The flat sides and the noted extensions along the wall and floor, in combination with the fan inlet side configuration, to be described, minimizes the spacing to the wall and floor and also minimizes the directional change for the air flow, which maximizes air velocity at surfaces 26 and 24, and thus volumetric air flow capacity. This results in a fan better suited for and more efficiently capable of drying either or both of surfaces 24 and 26 than prior fans.

Inner and outer perimeters 72 and 74 of outlet face 70 are radially spaced by a varying radial thickness therebetween. The varying radial thickness is at a minimum at wall 24 and floor 26, as shown at minimum radial thickness 88 and 90, respectively. Outlet face 70 has first, second, third and fourth segments 92, 94, 96, 98. First segment 92 is at room corner 22. Third segment 96 is diagonally opposite first segment 92 along a first diagonal line 100, FIG. 3. Second and fourth segments 94 and 98 are diagonally opposite each other along a second diagonal line 102 perpendicular to diagonal line 100. In some embodiments, the noted varying radial thickness is at a maximum at one or both of segments 94 and 98. In a preferred functional embodiment, the maximum radial thickness is only at 96, to optimize the exhaust shape by minimizing the amount of least useful airflow (which is through quadrant 96), and instead directing or using such otherwise least useful airflow to be directed into quadrant 92 which is the most useful airflow, to expand down into corner 22. FIG. 1 illustrates the preferred embodiment, including the preferred manufacturing embodiment, for rotomolding processing.

Outlet face 70 has first, second, third and fourth inner perimeter segments 104, 106, 108, 110. First inner perimeter segment 104 is at room corner 22. Third inner perimeter segment 108 is diagonally opposite first inner perimeter segment 104 along diagonal line 100. Second and fourth inner perimeter segments 106 and 110 are diagonally opposite each other along diagonal line 102. Outlet face 70 has a first inner perimeter diameter along diagonal line 100, and a second inner perimeter diameter along diagonal line 102, wherein the noted first inner perimeter diameter is greater than the noted second inner perimeter diameter. Outlet face 70 has an inner perimeter with a varying diameter thereacross. In the preferred embodiment, the varying diameter is at a maximum along diagonal line 100, and is at a minimum along diagonal line 102. Other embodiments may have other diameter relationships.

Intake cowling 54 has an upstream end 112 having an inlet face 114 lying in a plane preferably perpendicular or transverse to rotational axis 30 of the fan hub and of noncircular shape of variable radius from rotational axis 30. Inlet face 114 is defined by an inner perimeter 116 and an outer perimeter 118 at upstream end 112 of intake cowling 54. At least one and preferably both of perimeters 116 and 118 have the noted noncircular shape of variable radius. Outer perimeter 118 has an outer perimeter corner 120 at room corner 22. Outer perimeter 118 has first and second straight sides 122 and 124 meeting at outer perimeter corner 120. Side 122 extends along wall 24. Side 124 extends along floor 26. Inner and outer perimeters 116 and 118 are radially spaced by a varying radial thickness therebetween. The noted varying radial thickness is at a minimum at wall 24 and at floor 26 as respectively shown at 126 and 128, and is at a maximum at outer perimeter corner 120 as shown at 130, diagonally opposite quadrant 96.

Intake cowling 54 has an inner profile having a contoured intake surface 140, FIGS. 5-8, guiding air flow therealong at 38 from an upstream end 142 to a downstream end 144. Contoured intake surface 140 is tapered toward rotational axis 30 of the fan hub as contoured surface 140 extends from upstream to downstream (right to left in FIGS. 5-8). Exhaust cowling 56 has an inner profile having a contoured exhaust surface 146 guiding air flow therealong as shown at 39 from an upstream end 148 to a downstream end 150. Contoured exhaust surface 146 is tapered away from rotational axis 30 of the fan hub as contoured surface 146 extends from upstream to downstream (right to left in FIGS. 5-8). Upstream end 148 of contoured exhaust surface 146 is downstream of downstream end 144 of contoured intake surface 140. In other embodiments, the exhaust surface downstream of parting line 60 tapers away from axis 30 only in quadrant 92, and tapers towards axis 30 in all three remaining quadrants.

Housing 52 has an inner profile further preferably having a blade location zone surface 152, preferably upstream of parting line 60, though such zone may be at parting line 60 or downstream thereof. The fan blades are shown schematically in the drawings, and have an axial span between a leading blade edge 35, FIG. 7, and a trailing blade edge 37. Blade location zone surface 152 extends along the noted span generally aligned with the fan blades such as 36. Housing 52 has a varying inner profile, for example as shown at 140, 152, 146 defining a varying cross-sectional flow area, wherein the smallest cross-sectional flow area is preferably at blade location zone surface 152 for functional reasons, though for manufacturing reasons is at parting line 60. Blade location zone surface 152 is axially between downstream and 144 of contoured intake surface 140 and upstream and 148 of contoured exhaust surface 146. Blade location zone surface 152 has a constant inner diameter, and extends substantially parallel to rotational axis 30, and is radially aligned with the fan blades such as 36.

Upstream end 142 of contoured intake surface 140 defines a first cross sectional flow area. Downstream end 144 of contoured intake surface 140 defines a second cross sectional flow area. Upstream end 148 of contoured exhaust surface 146 defines a third cross sectional flow area. Downstream end 150 of contoured exhaust surface 146 defines a fourth cross sectional flow area. The noted first cross sectional flow area is greater than the noted second cross sectional flow area and greater than the noted third cross sectional flow area. Contoured exhaust surface 146 includes a ramp portion providing the noted tapered ramp 66 leading diagonally downwardly to room corner 22.

Figure 2:
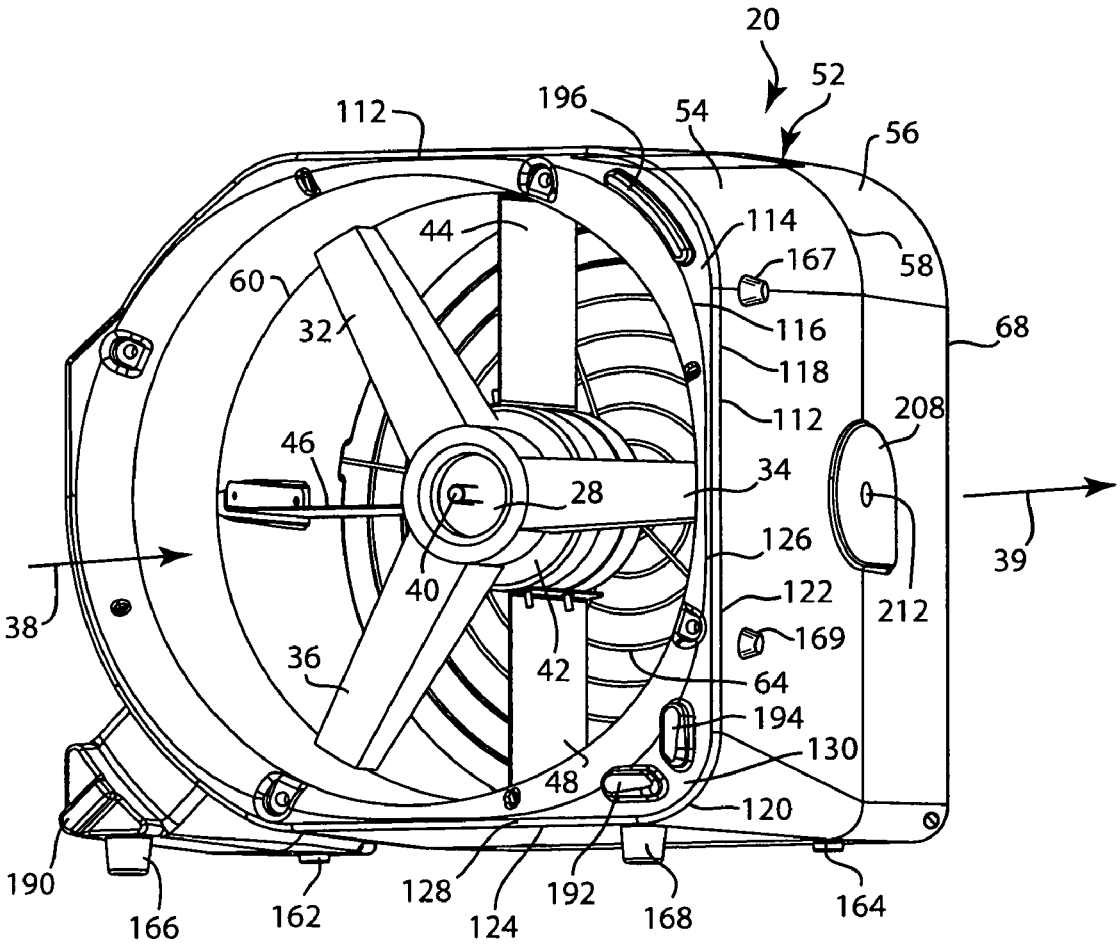
FIG. 2 is a perspective view of the inlet side of the fan of FIG. 1.
Figure 3:
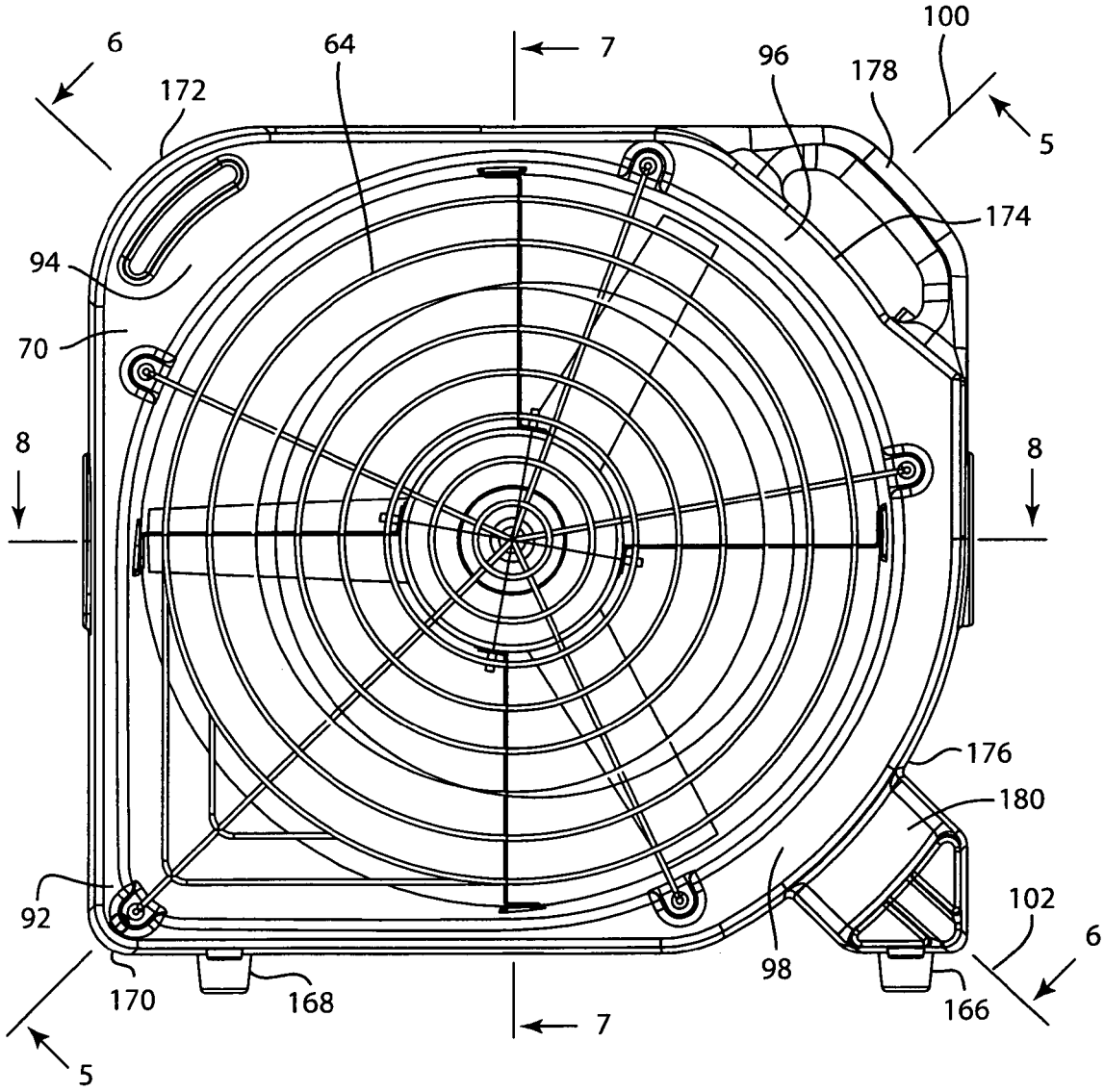
FIG. 3 is a rear elevation view of the fan of FIG. 1.
Figure 4:
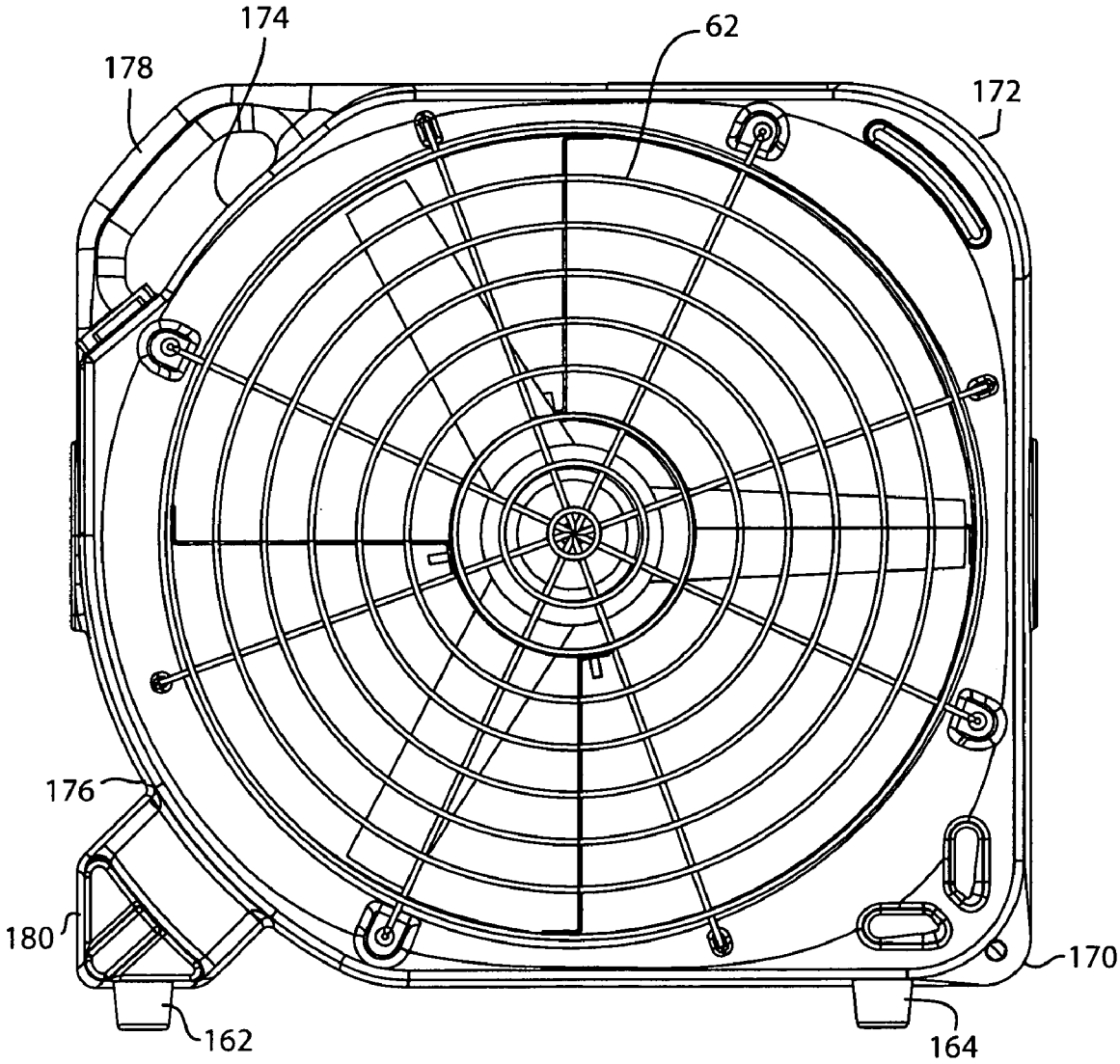
FIG. 4 is a front elevation view of the fan of FIG. 1.
Figure 7:
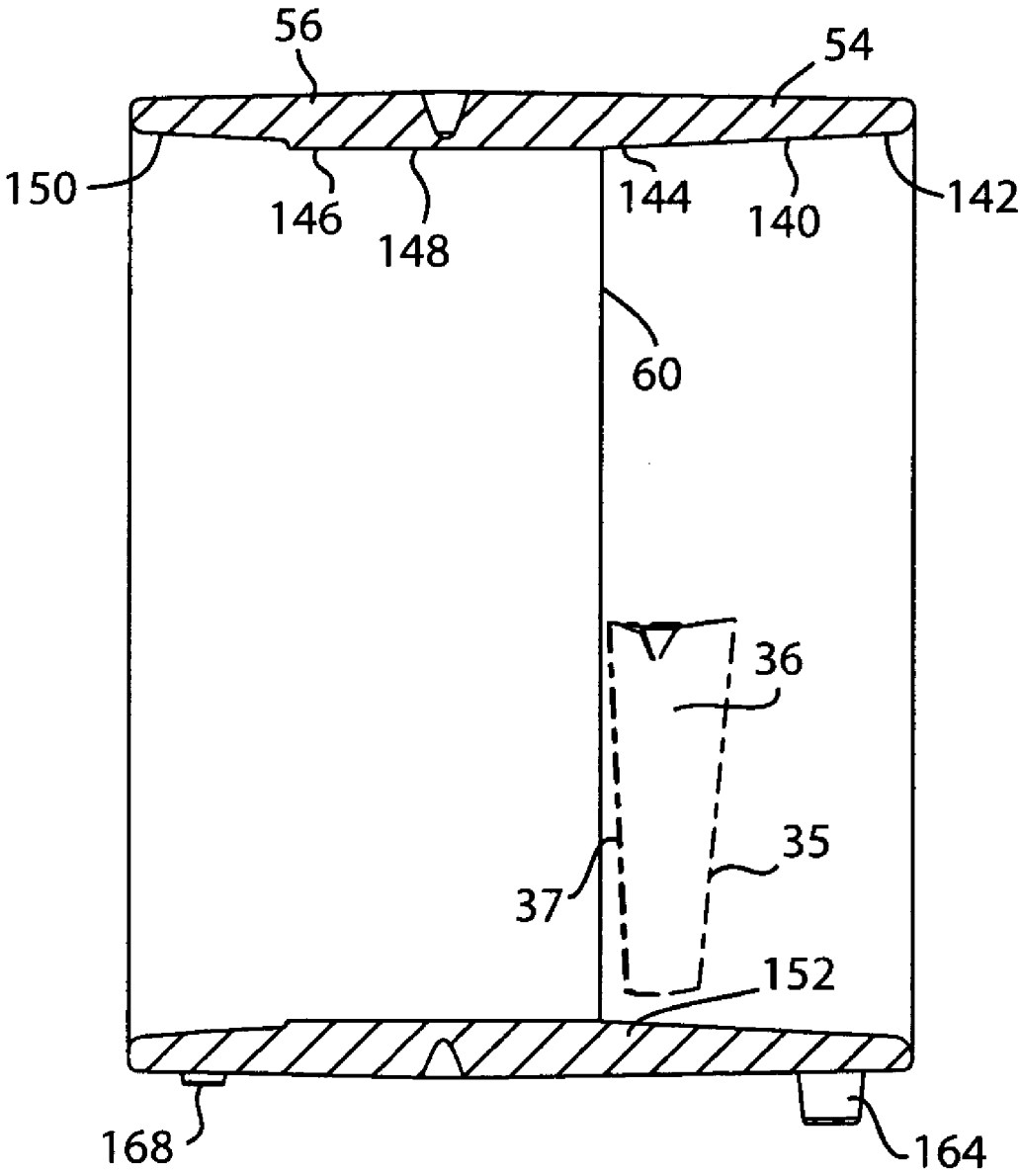
FIG. 7 is a sectional view taken along line 7-7 of FIG. 3.
Figure 8:
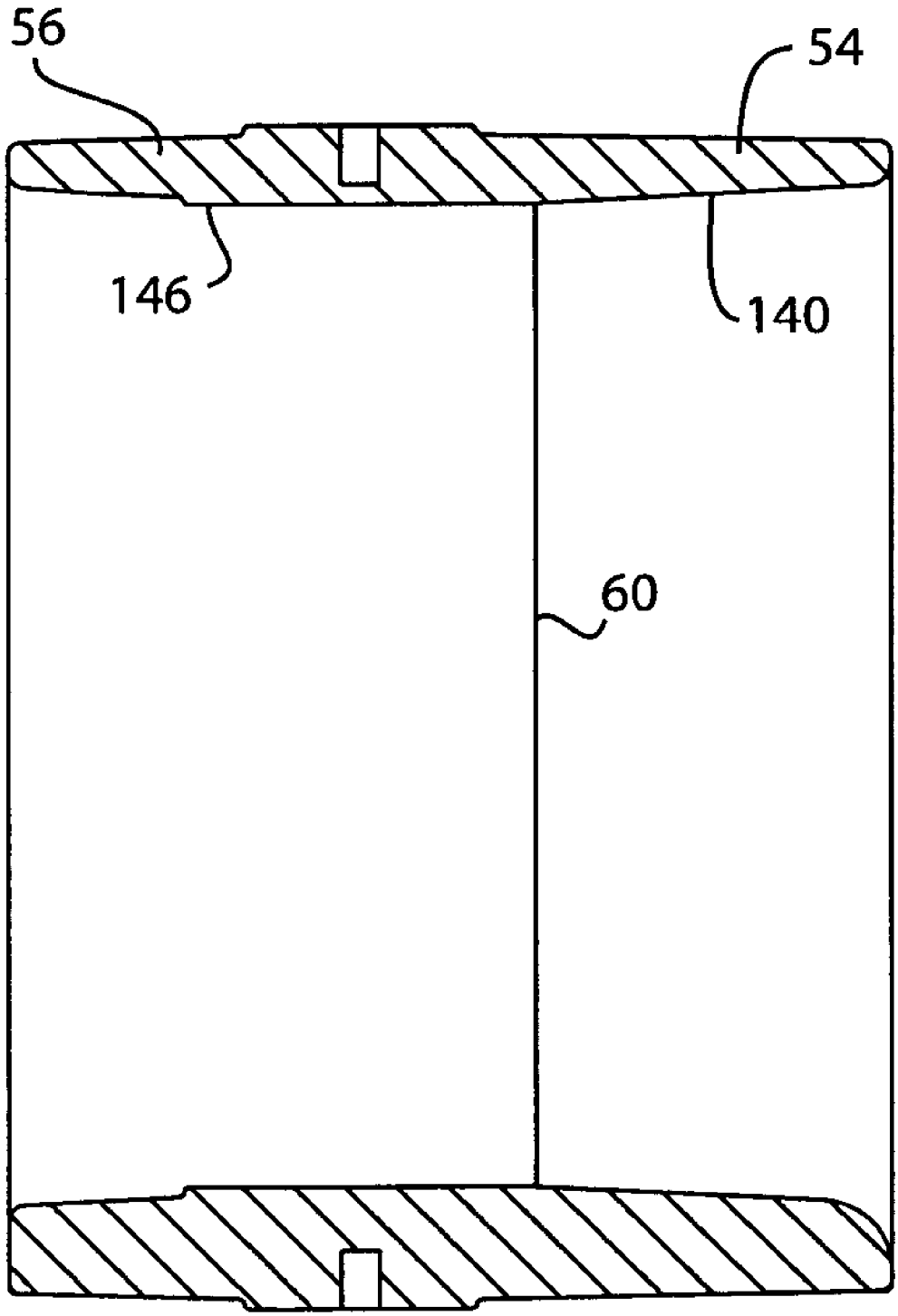
FIG. 8 is a sectional view taken along line 8-8 of FIG. 3.
Figure 9:
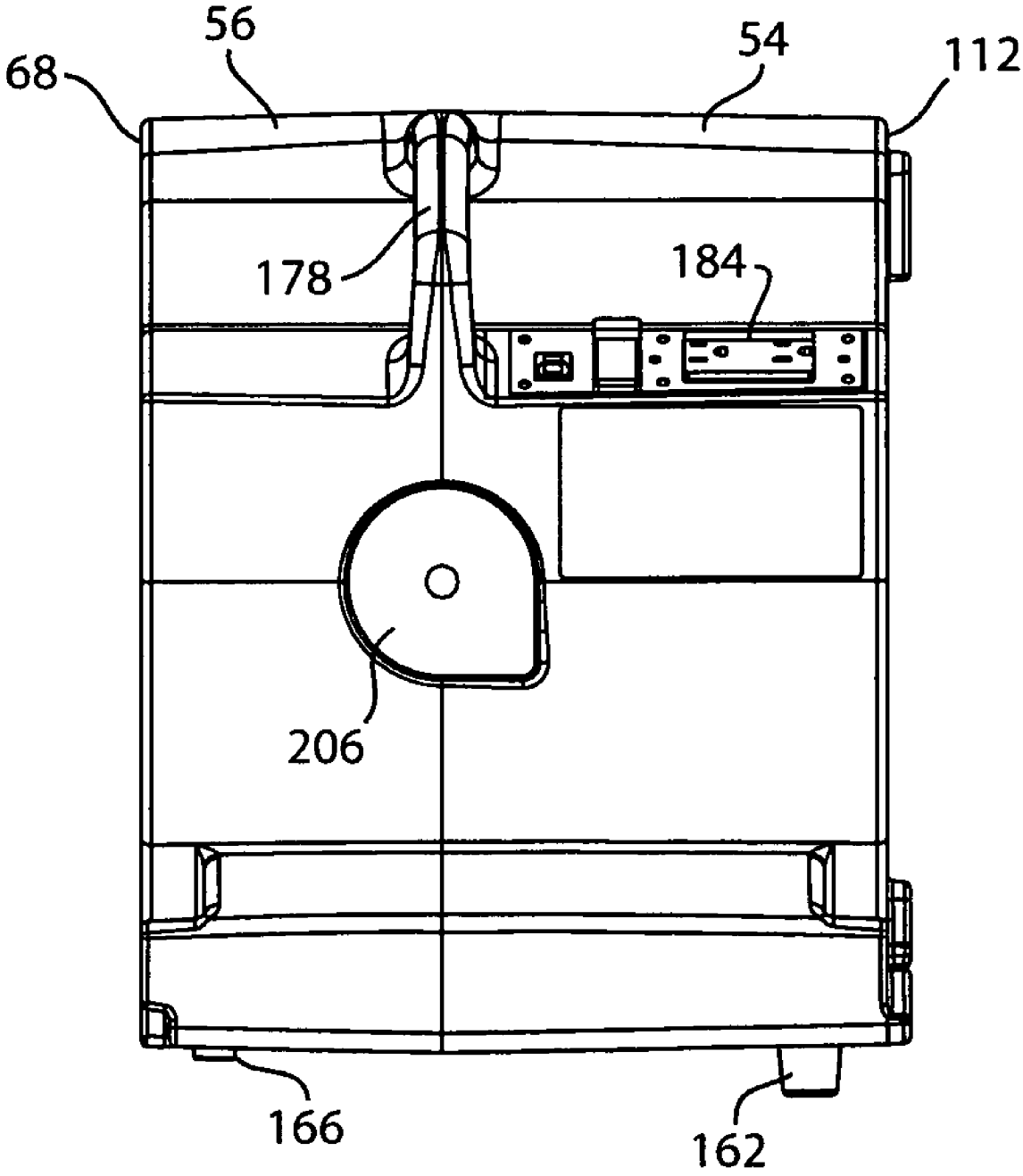
FIG. 9 is a side elevation view of the fan of FIG. 1.

A front pair of legs 162, 164, FIGS. 4, 7, 9, supports housing 52 on floor 26, and a rear pair of legs 166, 168, FIGS. 3, 7, 9, also supports the housing on the floor. The leg heights and/or mounting locations are selected to tilt the housing and the rotational axis 30 of the fan hub from horizontal to direct air flow from upstream to downstream, i.e. from 38 to 39, slightly downwardly toward room corner 22 and/or toward floor 26 and/or toward wall 24. Any or all of the legs may have an adjustable height, e.g., by threaded engagement along a stud or bolt mounted to the housing, to adjust the tilt toward corner 22 and/or wall 24 and/or floor 26. The legs also allow air to circulate and flow under the housing, between the housing and the floor, which is desirable for drying the floor beneath the housing. The side of the housing may have wall legs 167, 169, FIG. 2, for engaging wall 24. In various implementations, the legs tilt at least one of the housing and the rotational axis of the fan hub to direct air flow from upstream to downstream toward at least one of the floor, the wall, and the corner. In other implementations, the fan can be placed with face 70 or 114 on the floor or on the wall.

Housing 52 has first, second, third and fourth outer corners 170, 172, 174 and 176. First outer corner 170 is at room corner 22. Third outer corner 174 is diagonally opposite first outer corner 170 along diagonal line 100. Second and fourth outer corners 172 and 176 are diagonally opposite each other along diagonal line 102 perpendicular to diagonal line 100. Handle 178 on housing 52 is along diagonal line 100 and radially outboard of third outer corner 174. The housing has a leg 180 extending radially outwardly from fourth outer corner 176 along diagonal line 102 and engaging floor 26 to further support housing 52 on the floor. The handle is offset to one side, e.g., towards the inlet or the outlet, so that the operator does not have to carry the fan farther away from his/her body. The handle is also parallel to the flat inlet and outlet sides of the fan so that the operator does not have to twist his/her arm when carrying it nor have obstruction to the natural motion of his/her legs. The handle is also located as close to the center of gravity as possible of the fan, so that when held the fan hangs as close to vertical as possible and does not interfere with walking.

Figure 10:
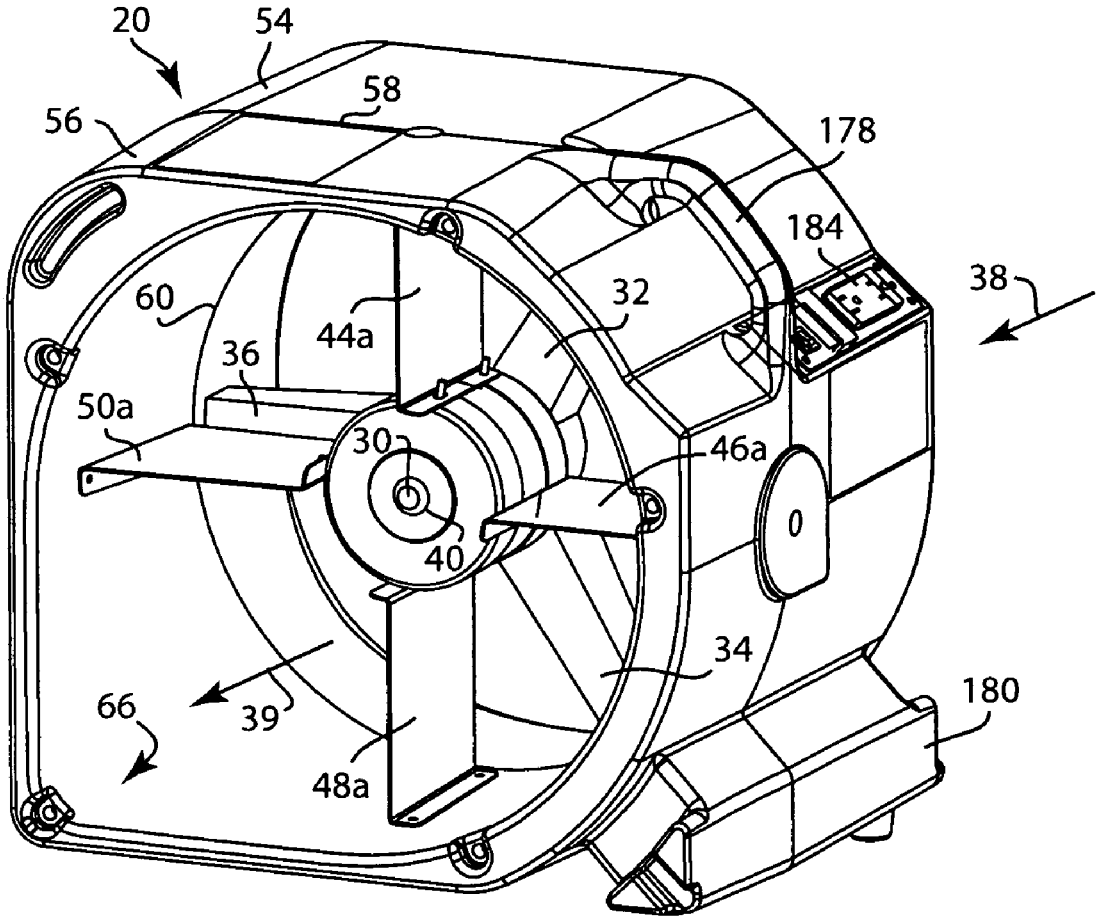
FIG. 10 is a view like FIG. 1 and shows an alternate embodiment.

Stator vanes 44, 46, 48, 50 support motor 42 in the housing and have an inner radial end at the motor and an outer radial end at the housing. The stator vanes extend radially between the housing and the motor and also extend axially and block airflow rotation about axis 30 and instead direct such airflow axially. The housing has an inner profile having a plurality of shoulder stand-offs such as 182, FIG. 1, of increasing radial thickness from upstream to downstream and providing motor mounting pads and engaging and supporting the outer radial ends of the stator vanes 44, 46, 48, 50. This embodiment is preferred because it enables the use of identical stator vanes 44, 46, 48, 50. In an alternate embodiment, shoulder stand-offs such as 182 are eliminated, and the outer radial ends of stator vanes 44*a*, 46*a*, 48*a*, 50*a*, FIG. 10 extending from upstream to downstream are tapered away from the rotational axis 30 of the fan hub as the outer radial ends of the stator vanes extend from upstream to downstream.

Further in the preferred embodiment, electrical controls for the fan are provided at an easily accessible location along the outer perimeter of the shroud housing as shown at 184, including a switch such as 186 and one or more outlet plugs such as 188, for providing electrical power to further downstream fans which may be connected in series or parallel. The location of the electrical component controls allows the operator to quickly and easily use the controls without bending over to the floor.

The inlet and outlet faces of the housing have a plurality of interlocking mating nubs and recesses such as 190, 192, 194, 196, 198, 200, etc. allowing vertical stacking of the fans (with axis 30 extending vertically), facilitating transport and/or storage. Leg 180 has recessed ends 202 and 204 providing a cord wrap for winding and storing the electrical cord within the entire fan's circumscribing cuboid, including during the noted stacking, thus keeping the cord out of the way during transfer and storage.

The housing has stand mounting pads 206 and 208 with threaded inserts 210 and 212 allowing the operator to mount the fan quickly on a stand and to point airflow 38, 39 along a desired direction.

External surfaces of the fan housing have a draft towards central parting line 58. This facilitates demolding of the plastic part. This also facilitates proper alignment of the fan to the wall. The draft angle of the external surfaces of the housing makes it easy for the operator to line up the axis of rotation of the fan at an angle to the wall.

Figure 11:
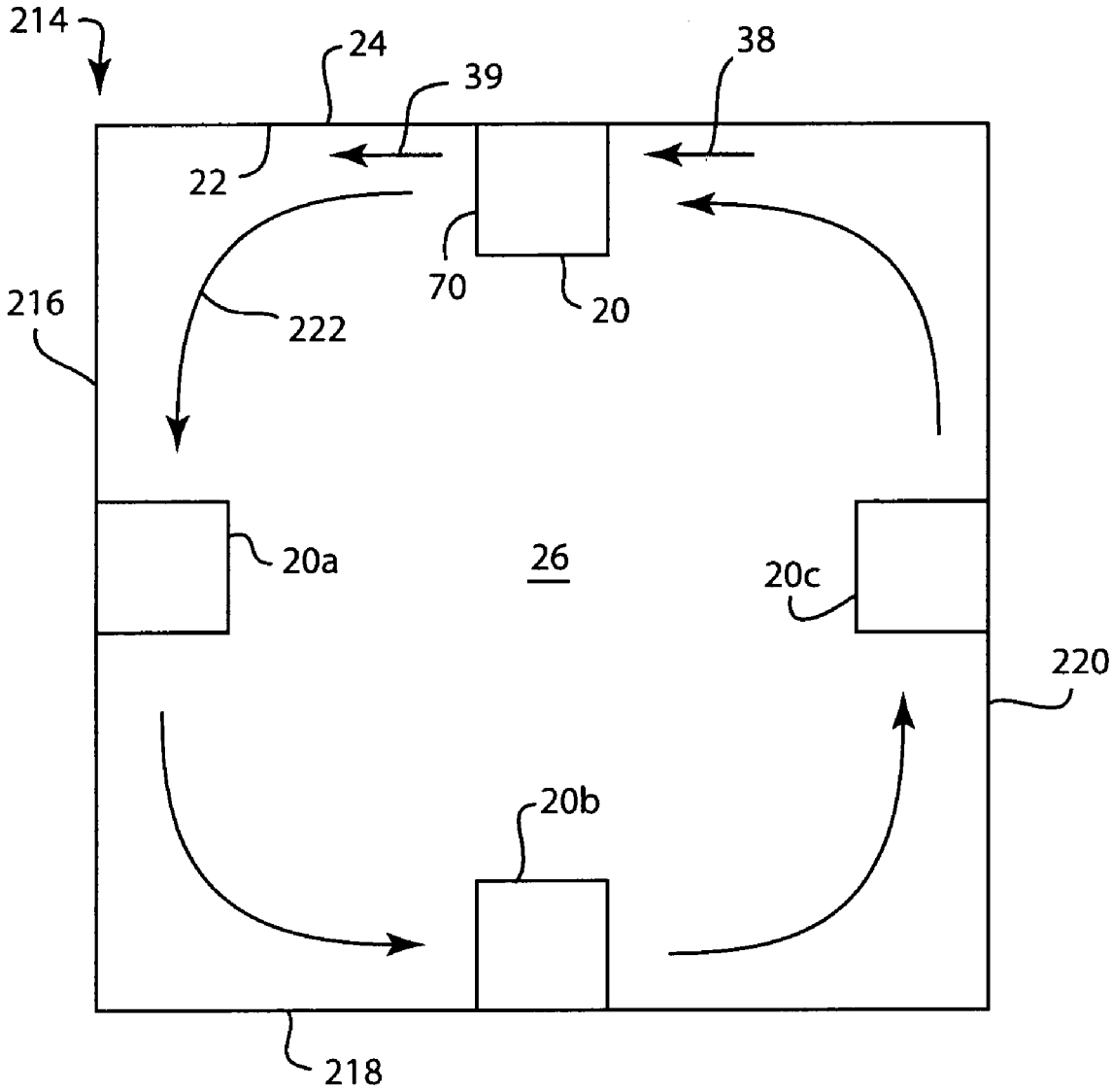
FIG. 11 is a top plan view of a room showing a counterclockwise drying flow pattern.
Figure 12:
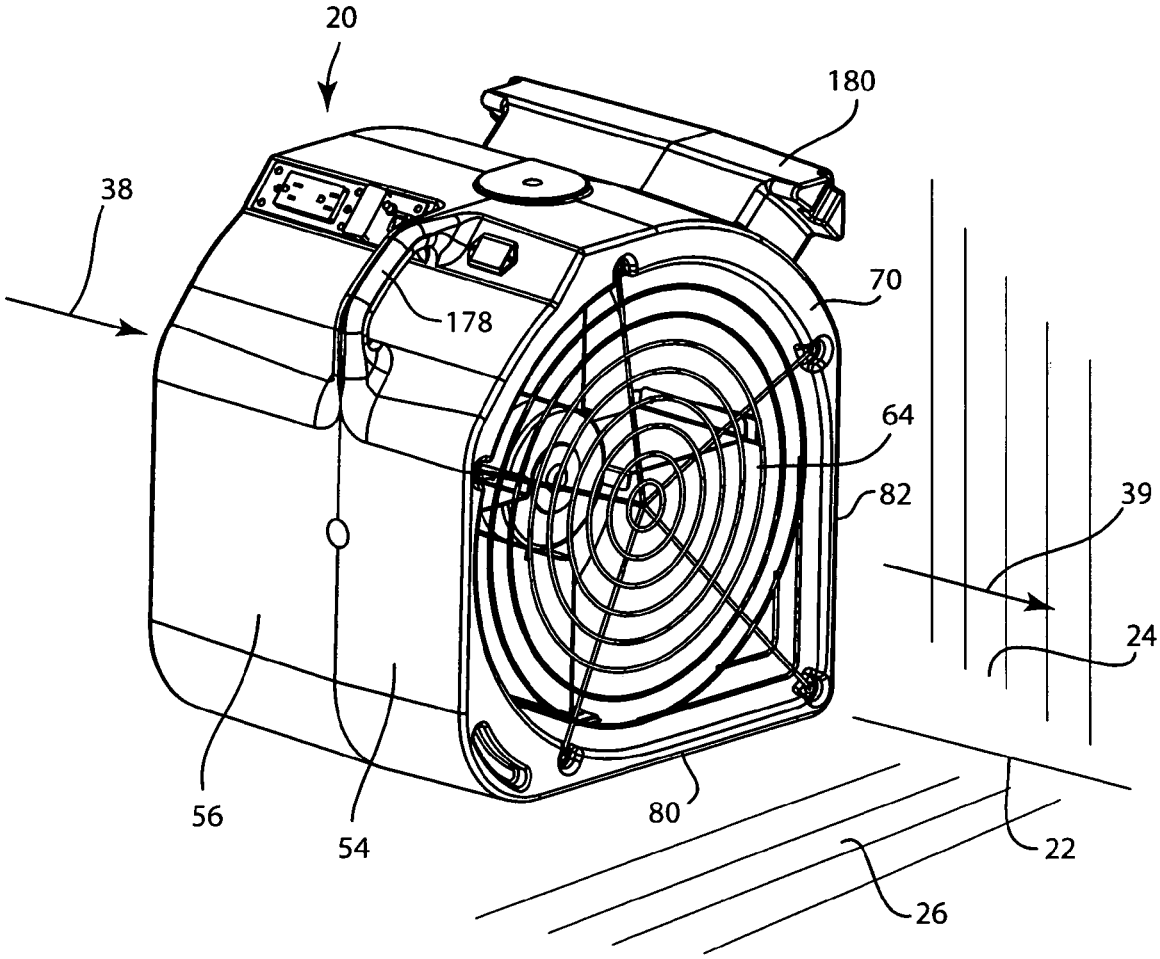
FIG. 12 is a view like FIG. 1 but showing a different fan orientation.
Figure 13:
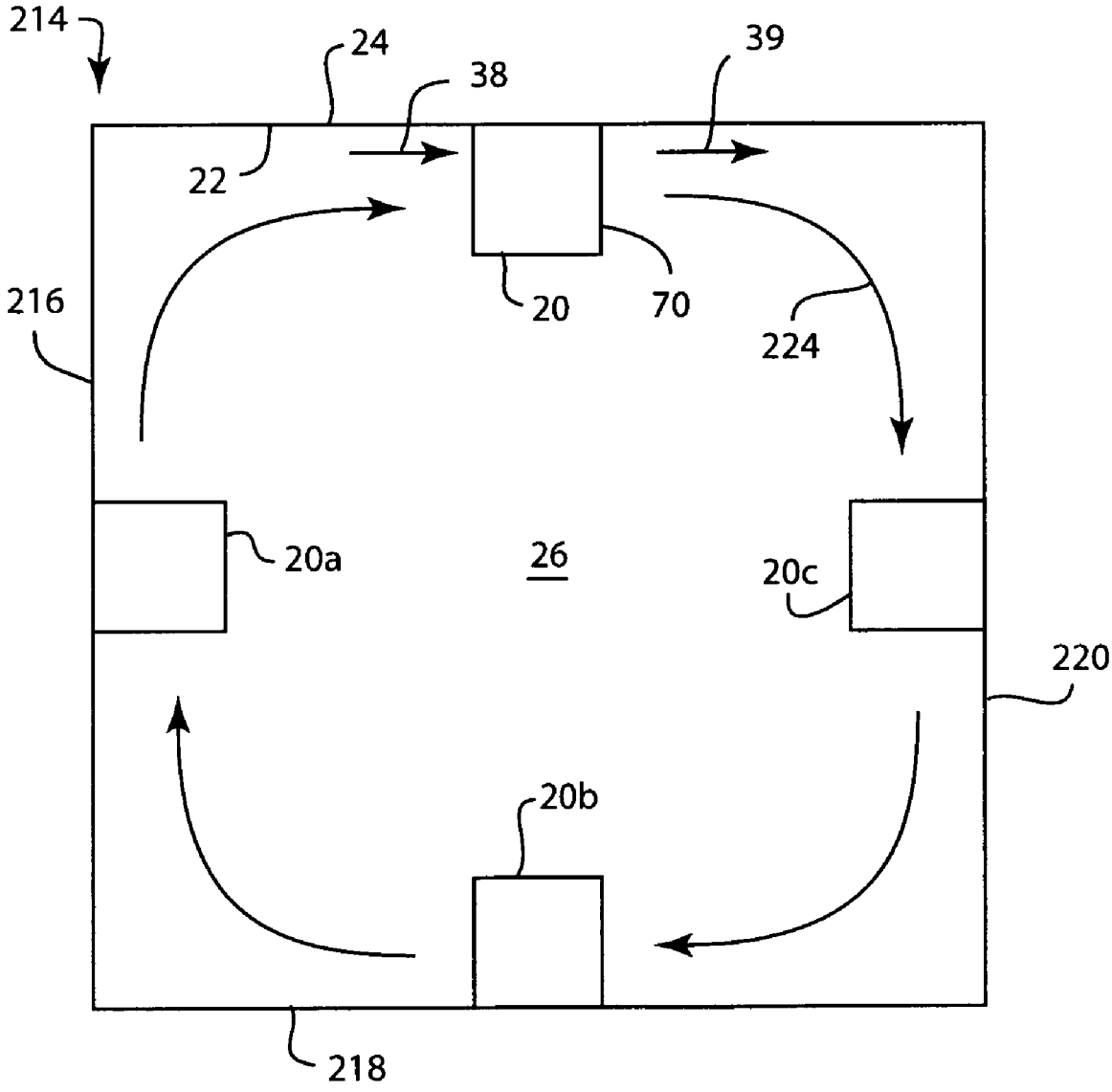
FIG. 13 is like FIG. 11 but shows a clockwise drying flow pattern around the room.

The fan orientation shown in FIG. 1 provides a counterclockwise drying flow pattern around a room as viewed from the ceiling, as illustrated in FIG. 11 showing a room 214 having four walls 24, 216, 218, 220 and four respective fans 20, 20*a*, 20*b*, 20*c* therealong and providing a counterclockwise drying flow pattern as shown at 222. To provide the noted flow pattern 222, side 80, FIG. 1, of outer perimeter 74 of outlet face 70 of the fan is against wall 24, and side 82 of outer perimeter 74 of outlet face 70 of the fan is on floor 26. The fan may be easily re-oriented to the position shown in FIG. 12, with side 82 of outer perimeter 74 of outlet face 70 against wall 24, and side 80 of outer perimeter 74 of outlet face 70 of the fan on the floor 26, to provide a clockwise drying flow pattern around the room as shown at 224 in FIG. 13. This latter orientation may be desirable in certain rooms, for drying a door jamb, etc. In this latter orientation, wall legs 167, 169, FIG. 2, are now on the floor 26, and legs 162, 164, 166, 168 are now against the wall 24. Additional legs may be provided, including on the same side of the housing as legs 167, 169, for additional support and/or control and variance of the flow angle relative to the floor and/or wall, for example in some embodiments, it has been found desirable to provide a downward angle of 4.5° for optimal drying.

It is recognized that various equivalents, alternatives and modifications are possible within the scope of the appended claims.

What is claimed is:

1. A drying fan comprising a fan hub rotational about an axis and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp both a) expanding the airflow and b) directing the airflow where desired, wherein said exhaust cowling has a downstream end having an outlet face of noncircular shape of variable radius from said rotational axis, wherein said outlet face is defined by an inner perimeter and an outer perimeter at said downstream end of said exhaust cowling, each of said perimeters having a perimeter corner at said tapered ramp, namely an inner perimeter corner at said tapered ramp, and an outer perimeter corner at said tapered ramp, wherein said inner perimeter has first and second straight sides meeting at said inner perimeter corner.

2. A drying fan comprising a fan hub rotational about an axis and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp both a) expanding the airflow and b) directing the airflow where desired, wherein said exhaust cowling has a downstream end having an outlet face of noncircular shape of variable radius from said rotational axis, wherein said outlet face is defined by an inner perimeter and an outer perimeter at said downstream end of said exhaust cowling, each of said perimeters having a perimeter corner at said tapered ramp, namely an inner perimeter corner at said tapered ramp, and an outer perimeter corner at said tapered ramp, wherein said outer perimeter has first and second straight sides meeting at said outer perimeter corner, said inner perimeter has first and second straight sides meeting at said inner perimeter corner, said first side of said inner perimeter extends generally parallel to said first side of said outer perimeter, and said second side of said inner perimeter extends generally parallel to said second side of said outer perimeter.

3. A drying fan comprising a fan hub rotational about an axis and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp both a) expanding the airflow and b) directing the airflow where desired, wherein said exhaust cowling has a downstream end having an outlet face of noncircular shape of variable radius from said rotational axis, wherein said outlet face is defined by an inner perimeter and an outer perimeter at said downstream end of said exhaust cowling, each of said perimeters having a perimeter corner at said tapered ramp, namely an inner perimeter corner at said tapered ramp, and an outer perimeter corner at said tapered ramp, wherein said inner and outer perimeters are radially spaced by a varying radial thickness therebetween, wherein said outer perimeter has first and second straight sides meeting at said outer perimeter corner, said inner perimeter has first and second straight sides meeting at said inner perimeter corner, said first side of said inner perimeter extends generally parallel to said first side of said outer perimeter, said second side of said inner perimeter extends generally parallel to said second side of said outer perimeter, and said varying radial thickness is at a minimum between said first sides of said inner and outer perimeters and said second sides of said inner and outer perimeters.

4. A drying fan comprising a fan hub rotational about an axis and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp both a) expanding the airflow and b) directing the airflow where desired, wherein said exhaust cowling has a downstream end having an outlet face of noncircular shape of variable radius from said rotational axis, wherein said outlet face has first, second, third, and fourth inner perimeter segments, said first inner perimeter segment being at said tapered ramp, said third inner perimeter segment being diagonally opposite said first inner perimeter segment along a first diagonal line, said second and fourth inner perimeter segments being diagonally opposite each other along a second diagonal line perpendicular to said first diagonal line, said first diagonal line defining a first radius therealong from said rotational axis to said first inner perimeter segment, said second diagonal line defining a second radius therealong from said rotational axis to said second inner perimeter segment, said first diagonal line defining a third radius therealong from said rotational axis to said third inner perimeter segment, said second diagonal line defining a fourth radius therealong from said rotational axis to said fourth inner perimeter segment, said first radius being greater than each of said second, third and fourth radii.

5. A drying fan comprising a fan hub rotational about an axis and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp both a) expanding the airflow and b) directing the airflow where desired, wherein said intake cowling has an upstream end having an inlet face of noncircular shape of variable radius from said rotational axis, wherein said inlet face is defined by an inner perimeter and an outer perimeter at said upstream end of said intake cowling, at least one of said perimeters having said noncircular shape of variable radius, wherein said inner and outer perimeters are radially spaced by a varying radial thickness therebetween, wherein said inlet face has first, second, third, and fourth corners, said first corner being axially aligned with said tapered ramp, said first and third corners being diagonally opposite each other along a first diagonal line, said second and fourth corners being diagonally opposite each other along a second diagonal line perpendicular to said first diagonal line, said first and second corners having a first sidewall extending therebetween, said first and fourth corners having a second sidewall extending therebetween, wherein said varying radial thickness between said inner and outer perimeters of said inlet face is at a minimum at said first and second walls.

6. A drying fan comprising a fan hub rotational about an axis and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp both a) expanding the airflow and b) directing the airflow where desired, and comprising a set of one or more legs supporting said housing on a floor and tilting at least one of said housing and the rotational axis of said hub from horizontal to direct airflow from upstream to downstream along a downwardly tilted direction, and comprising a first set of one or more upstream legs supporting said housing on said floor, and a second set of one or more downstream legs supporting said housing on said floor, said first set of legs having a greater effective vertical height than said second set of legs.

7. A drying fan comprising a fan hub rotational about an axis and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp both a) expanding the airflow and b) directing the airflow where desired, wherein said housing has first, second, third, and fourth outer corners, said first outer corner being axially aligned with said tapered ramp, said third outer corner being diagonally opposite said first outer corner along a first diagonal line, said second and fourth outer corners being diagonally opposite each other along a second diagonal line perpendicular to said first diagonal line, and comprising a handle on said housing along an arc through said third outer corner between said second and fourth outer corners.

8. The drying fan according to claim 7 wherein said handle is on said housing along said first diagonal line and radially outboard of said third outer corner.

9. A drying fan comprising a fan hub rotational about an axis and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp both a) expanding the airflow and b) directing the airflow where desired, wherein said housing has first, second, third and fourth outer corners, said first outer corner being axially aligned with said tapered ramp, said third outer corner being diagonally opposite said first outer corner along a first diagonal line, said second and fourth outer corners being diagonally opposite each other along a second diagonal line perpendicular to said first diagonal line, said housing having a leg extending radially outwardly from said fourth outer corner along said second diagonal line and engagable with a floor to support said housing on said floor.

10. A drying fan comprising a fan hub rotational about an axis and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp both a) expanding the airflow and b) directing the airflow where desired, wherein said housing has first, second, third and fourth outer corners, said first outer corner being axially aligned with said tapered ramp, said third outer corner being diagonally opposite said first outer corner along a first diagonal line, said second and fourth outer corners being diagonally opposite each other along a second diagonal line perpendicular to said first diagonal line, said housing having a leg extending radially outwardly from said fourth corner along said second diagonal line and engageable with a wall.

11. A drying fan comprising a fan hub rotational about an axis and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp both a) expanding the airflow and b) directing the airflow where desired, wherein said housing has first, second, third and fourth outer corners, said first outer corner being axially aligned with said tapered ramp, said third outer corner being diagonally opposite said first outer corner along a first diagonal line, said second and fourth outer corners being diagonally opposite each other along a second diagonal line perpendicular to said first diagonal line, one of said corners having a leg extending radially outwardly therefrom along one of said diagonal lines and having recessed axial ends providing an electrical cord wrap.

12. A drying fan comprising a fan hub rotational about an axis and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp both a) expanding the airflow and b) directing the airflow where desired, and comprising a plurality of stator vanes supporting a motor for rotation of said hub in said housing, said vanes extending radially between said motor and said housing and having an inner radial end at said motor and an outer radial end at said housing, said housing having an inner profile having a plurality of shoulder stand-offs engaging and supporting said outer radial ends of said vanes.

13. A drying fan comprising a fan hub rotational about an axis and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp both a) expanding the airflow and b) directing the airflow where desired, wherein said fan is located adjacent a wall, and said housing is a plastic part having external surfaces having a draft towards a central parting line facilitating demolding of the plastic part and also facilitating proper alignment of the fan to the wall wherein the angle of the draft of the external surfaces of the housing enables an operator to line up the axis of rotation of the fan at an angle to the wall.

14. A drying fan for water damage restoration, particularly for drying a room corner extending axially along an interface between a wall and a floor, comprising a fan hub rotational about an axis generally parallel to said axial extension of said room corner and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp leading diagonally downwardly to said room corner, wherein said generally parallel extension of said rotational axis of said hub relative to said axial extension of said room corner is within 10° thereof, namely within a cone angle of 10°.

15. A drying fan for water damage restoration, particularly for drying a room corner extending axially along an interface between a wall and a floor, comprising a fan hub rotational about an axis generally parallel to said axial extension of said room corner and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp leading diagonally downwardly to said room corner, wherein said exhaust cowling has a downstream end having an outlet face of noncircular shape of variable radius from said rotational axis, wherein said outlet face is defined by an inner perimeter and an outer perimeter at said downstream end of said exhaust cowling, each of said perimeters having a perimeter corner at said room corner, namely an inner perimeter corner at said room corner, and an outer perimeter corner at said room corner, wherein said inner perimeter has first and second straight sides meeting at said inner perimeter corner, said first side extending generally parallel to said wall, said second side extending generally parallel to said floor.

16. A drying fan for water damage restoration, particularly for drying a room corner extending axially along an interface between a wall and a floor, comprising a fan hub rotational about an axis generally parallel to said axial extension of said room corner and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp leading diagonally downwardly to said room corner, wherein said exhaust cowling has a downstream end having an outlet face of noncircular shape of variable radius from said rotational axis, wherein said outlet face is defined by an inner perimeter and an outer perimeter at said downstream end of said exhaust cowling, each of said perimeters having a perimeter corner at said room corner, namely an inner perimeter corner at said room corner, and an outer perimeter corner at said room corner, wherein said outer perimeter has first and second straight sides meeting at said outer perimeter corner, said first side extending along said wall, said second side extending along said floor, said inner perimeter has first and second straight sides meeting at said inner perimeter corner, said first side of said inner perimeter extending generally parallel to said first side of said outer perimeter, said second side of said inner perimeter extending generally parallel to said second side of said outer perimeter.

17. A drying fan for water damage restoration, particularly for drying a room corner extending axially along an interface between a wall and a floor, comprising a fan hub rotational about an axis generally parallel to said axial extension of said room corner and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp leading diagonally downwardly to said room corner, wherein said exhaust cowling has a downstream end having an outlet face of noncircular shape of variable radius from said rotational axis, wherein said outlet face is defined by an inner perimeter and an outer perimeter at said downstream end of said exhaust cowling, each of said perimeters having a perimeter corner at said room corner, namely an inner perimeter corner at said room corner, and an outer perimeter corner at said room corner, wherein said inner and outer perimeters are radially spaced by a varying radial thickness therebetween, wherein said varying radial thickness is at a minimum at said wall and at said floor.

18. A drying fan for water damage restoration, particularly for drying a room corner extending axially along an interface between a wall and a floor, comprising a fan hub rotational about an axis generally parallel to said axial extension of said room corner and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp leading diagonally downwardly to said room corner, wherein said exhaust cowling has a downstream end having an outlet face of noncircular shape of variable radius from said rotational axis, wherein said outlet face has first, second, third and fourth inner perimeter segments, said first inner perimeter segment being at said room corner, said third inner perimeter segment being diagonally opposite said first inner perimeter segment along a first diagonal line, said second and fourth inner perimeter segments being diagonally opposite each other along a second diagonal line perpendicular to said first diagonal line, said first diagonal line defining a first radius therealong from said rotational axis to said first inner perimeter segment, said second diagonal line defining a second radius therealong from said rotational axis to said second inner perimeter segment, said first diagonal line defining a third radius therealong from said rotational axis to said third inner perimeter segment, said second diagonal line defining a fourth radius therealong from said rotational axis to said fourth inner perimeter segment, said first radius being greater than each of said second, third and fourth radii.

19. A drying fan for water damage restoration, particularly for drying a room corner extending axially along an interface between a wall and a floor, comprising a fan hub rotational about an axis generally parallel to said axial extension of said room corner and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp leading diagonally downwardly to said room corner, wherein said intake cowling has an upstream end having an inlet face of noncircular shape of variable radius from said rotational axis, wherein said inlet face is defined by an inner perimeter and an outer perimeter at said upstream end of said intake cowling, at least one of said perimeters having said noncircular shape of variable radius, wherein said inner and outer perimeters are radially spaced by a varying radial thickness therebetween, wherein said varying radial thickness is at a minimum at said wall and at said floor.

20. The drying fan according to claim 19 wherein said inlet face has first, second, third and fourth corners, said first corner of said inlet face being at said room corner, said first and third corners of said inlet face being diagonally opposite each other along a first diagonal line, said second and fourth corners of said inlet face being diagonally opposite each other along a second diagonal line perpendicular to said first diagonal line, said first and second corners of said inlet face having a first sidewall extending therebetween along said floor, said first and fourth corners of said inlet face having a second sidewall extending therebetween along said room wall, wherein said varying radial thickness between said inner and outer perimeters of said inlet face is at a minimum at said first and second sidewalls.

21. A drying fan for water damage restoration, particularly for drying a room corner extending axially along an interface between a wall and a floor, comprising a fan hub rotational about an axis generally parallel to said axial extension of said room corner and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp leading diagonally downwardly to said room corner, and comprising a set of one or more legs supporting said housing on said floor and tilting at least one of said housing and the rotational axis of said hub from horizontal to direct airflow from upstream to downstream toward at least one of said corner, said floor and said wall.

22. The drying fan according to claim 21 comprising a first set of one or more upstream legs supporting said housing on said floor, and a second set of one or more downstream legs supporting said housing on said floor, said first set of legs having a greater effective vertical height than said second set of legs.

23. A drying fan for water damage restoration, particularly for drying a room corner extending axially along an interface between a wall and a floor, comprising a fan hub rotational about an axis generally parallel to said axial extension of said room corner and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp leading diagonally downwardly to said room corner, and comprising a first set of one or more legs supporting said housing on said floor, and a second set of one or more legs for engaging said wall.

24. A drying fan for water damage restoration, particularly for drying a room corner extending axially along an interface between a wall and a floor, comprising a fan hub rotational about an axis generally parallel to said axial extension of said room corner and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp leading diagonally downwardly to said room corner, wherein said housing has first, second, third and fourth outer corners, said first outer corner being at said room corner, said third outer corner being diagonally opposite said first outer corner along a first diagonal line, said second and fourth outer corners being diagonally opposite each other along a second diagonal line perpendicular to said first diagonal line, and comprising a handle on said housing along an arc through said third outer corner between said second and fourth outer corners.

25. The drying fan according to claim 24 wherein said handle is on said housing along said first diagonal line and radially outboard of said third outer corner.

26. A drying fan for water damage restoration, particularly for drying a room corner extending axially along an interface between a wall and a floor, comprising a fan hub rotational about an axis generally parallel to said axial extension of said room corner and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp leading diagonally downwardly to said room corner, wherein said housing has first, second, third and fourth outer corners, said first outer corner being at said room corner, said third outer corner being diagonally opposite said first outer corner along a first diagonal line, said second and fourth outer corners being diagonally opposite each other along a second diagonal line perpendicular to said first diagonal line, said housing having a leg extending radially outwardly from said fourth outer corner along said second diagonal line and engaging said floor to support said housing on said floor.

27. A drying fan for water damage restoration, particularly for drying a room corner extending axially along an interface between a wall and a floor, comprising a fan hub rotational about an axis generally parallel to said axial extension of said room corner and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp leading diagonally downwardly to said room corner, wherein said housing has first, second, third and fourth outer corners, said first outer corner being at said room corner, said third outer corner being diagonally opposite said first outer corner along a first diagonal line, said second and fourth outer corners being diagonally opposite each other along a second diagonal line perpendicular to said first diagonal line, said housing having a leg extending radially outwardly from said fourth outer corner along said second diagonal line and engaging said wall.

28. A drying fan for water damage restoration, particularly for drying a room corner extending axially along an interface between a wall and a floor, comprising a fan hub rotational about an axis generally parallel to said axial extension of said room corner and having a plurality of fan blades extending radially therefrom for moving air along an axial flow direction from upstream to downstream upon rotation of said hub, said hub being mounted in a shrouded housing having an axial flow path therethrough, said housing having an intake cowling receiving intake air, and an exhaust cowling discharging exhaust air, said exhaust cowling having a tapered ramp leading diagonally downwardly to said room corner, comprising a plurality of stator vanes supporting a motor for rotation of said hub in said housing, said vanes extending radially between said hub and said housing and having an inner radial end at said hub and an outer radial end at said housing, said housing having an inner profile having a plurality of shoulder stand-offs supporting said outer radial ends of said vanes.

* * * * *